US005098367A

United States Patent [19]

Bullinger

[11] Patent Number: 5,098,367

[45] Date of Patent: Mar. 24, 1992

[54] SEAT COVER FORMING MACHINE

[75] Inventor: Robert E. Bullinger, Mesa, Ariz.

[73] Assignee: The Tranzonic Companies, Pepper Pike, Ohio

[21] Appl. No.: 581,464

[22] Filed: Sep. 12, 1990

[51] Int. Cl.[5] ..... B31D 1/00; B65H 45/28

[52] U.S. Cl. ..... 493/357; 493/359; 493/361; 493/362; 493/960

[58] Field of Search ..... 493/356, 357, 359, 361, 493/362, 960

[56] References Cited

U.S. PATENT DOCUMENTS

| | | | |
|---|---|---|---|
| 1,874,728 | 8/1932 | Willis | 493/357 |
| 2,020,668 | 11/1935 | Wandel | 493/960 |
| 2,058,877 | 10/1936 | Hitchcock | 493/357 |
| 2,280,092 | 4/1942 | Kirch et al. | 493/369 |
| 4,190,242 | 2/1980 | Bolza-Schunemann | 493/3537 |
| 4,969,862 | 11/1990 | Ehlscheid | 493/359 |

FOREIGN PATENT DOCUMENTS

| | | | |
|---|---|---|---|
| 2853741 | 7/1980 | Fed. Rep. of Germany | 493/359 |

*Primary Examiner*—William E. Terrell

*Attorney, Agent, or Firm*—D. Peter Hochberg; Mark Kusner; Louis J. Weisz

[57] ABSTRACT

A device for fabricating toilet seat covers from paper sheeting comprises three paper shearing and folding assemblies positioned one over the other, each assembly including a drive roll, as well as two additional compression rolls which shear and fold the sheeting. Three layers of the sheeting are fed simultaneously through rotary cutting rolls, and subsequently to the drive rolls associated with each of the assemblies. While one of the layers is fed to the bottom assembly drive roll, a double layer of sheeting proceeds to the drive roll of the middle assembly. There the double layer of sheeting is separated, with one layer being fed to the drive roll of the top assembly, and other layer proceeding through the other compression rolls of the middle assembly. Completed covers exiting from the superimposed assemblies are collated and transferred by transport and collating belts to a transversely adjustable ejection mechanism where the covers are ejected from the device. In one embodiment, doubly folded covers are made by initially prefolding the sheeting by passing it over a doubling guide and smoothing rolls before feeding the folded sheeting to rotary cutting rolls and subsequently processing it through shearing and folding assemblies.

2 Claims, 2 Drawing Sheets

SEAT COVER FORMING MACHINE

TECHNICAL FIELD

This invention relates to continuous paper cutting, shearing and folding processing lines. More particularly, this invention relates to continuous cutting, shearing, and folding machines for fabricating paper sheeting into toilet seat covers at greatly increased rates. Specifically, this invention relates to paper toilet seat cover fabricating machines positioned in vertically stacked arrays, and to modifications thereof that permit the operative synchronization of the machines so that the toilet seat covers exiting the machines can be collated with each other in sheaves, facilitating ejection of the covers from the machine arrays.

BACKGROUND OF THE INVENTION

In order to provide cleanliness, and to reduce exposure to disease, public rest room facilities are commonly provided with fixtures that dispense paper toilet seat covers intended for temporary positioning on toilet seats by the users thereof. Body contact with the seat is thereby avoided, and the cover can be subsequently disposed on by flushing the same down the toilet.

While the use of the covers is favored by many users of such facilities, to be economically feasible, the covers must be manufactured at the lowest possible cost. To enable high-volume, low cost production to be achieved, continuous paper cutting, shearing, and folding machines have been designed by Kerr Engineering Company of South El Monte, Calif., which automatically die cut the covers' center hole, and disjoin and fold the covers, using paper stock continuously fed to the machines from rolls of paper sheeting.

While such automated machinery allows toilet set covers of the type described to be rapidly produced, it would be economically desirable to increase the production rate of manufacturing operation utilizing such machines even further. To enable this to be accomplished, it has been suggested in the past to stack two such machines, one on the other, so as to double the rate of toilet seal cover production from a manufacturing line. However, when such machines are stacked in more than double tiers, problems have been encountered in synchronizing the feed of the paper sheeting to the machines so that the covers exiting the individual machine tiers can be collated in sheaves and automatically removed from the processing line. Thus, for example, triply stacked machines have not been used, quite possibly because of the described difficulties encountered in collecting the covers emerging from each of the superimposed machines in collated sheaves and ejecting them from the machines in ordered files.

Furthermore, toilet seat covers manufactured by machines of the type described have traditionally been folded in half, i.e., "one-half fold" covers, during the course of their manufacture. A disadvantage of one-half fold covers, however, have been that they require relatively sizeable dispensers for storage prior to use, and these in turn necessitate significant wall space to accommodate. While such requirement does not always cause a problem, adequate space is frequently not available in restrooms, for example, in those located in buses and airplanes. Consequently, it is oftentimes desirable to provide doubly folded, or "one-quarter" fold toilet seat covers, where the covers are intended for use in restrooms with limited space.

BRIEF DESCRIPTION OF THE INVENTION

In view of the foregoing, therefore, it is a first aspect of this invention to provide toilet seat cover manufacturing lines having increased rates of manufacture.

It is a second aspect of this invention to provide three-tiered paper cutting, shearing, and folding machine arrays.

A further aspect of this invention is to provide three superimposed paper cutting, shearing, and folding machines that collate product emerging therefrom into files of adjacent covers.

Still another aspect of this invention is to provide a three-tiered toilet seat cover fabrication line that includes one drive roll that feeds the machines on the upper two tiers.

Another aspect of this invention is to provide more compactly folded toilet seat covers.

An additional aspect of this invention is to provide a feed system apparatus that allows the production of doubly folded or "one-quarter fold" toilet seat covers on toilet seat fabricating machines.

Yet a further aspect of this invention is to provide a product ejection device that can be adjusted to accommodate the ejection of either singly or doubly folded toilet seat covers from a machine designed to fabricate either of such products.

The preceding and additional aspects of this invention are provided by a device for fabricating cut, disjoined, and singly folded paper products from rolls of paper sheeting. The device comprises sheeting feed means, rotary cutting rolls, paper shearing and folding assemblies, product transport and collating means, product ejection means and motive means. Each of said assemblies includes a drive roll that supplies at least one of said assemblies with sheeting from said sheeting feed means that has been cut by said rotary cutting rolls, said assemblies serving the shear and fold said sheeting. Three of said assemblies are mounted one over the other in a vertical array comprising top, middle, and bottom assemblies. The drive roll of the middle assembly supplying cut sheeting to the drive roll of said top assembly and to said middle assembly. The rotary cutting rolls, paper shearing and folding assemblies, transport and collating means, and product ejection means are coordinately interconnected with, and driven by said motive means. Finished product exiting from said top assembly is transported to, and collated with such product exiting from said middle assembly, and said collated product is transported and collated by said product transport and collating means with such product exiting from said bottom assembly. The product thus collated is then ejected from said device by said product ejection means.

The preceding and still further aspects of this invention are provided by side entry paper sheeting feed means comprising a doubling guide over which paper sheeting is passed and thereafter fed through two rollers positioned substantially at right angles to said doubling guide, thereby folding said sheeting in half.

The preceding and still other aspects of the invention are provided by a device for fabricating cut, disjoined, and doubly folded paper products from rolls of paper sheeting. The device includes at least one side entry paper sheeting feed means, rotary cutting rolls, at least one paper shearing and folding assembly, product transfer means, product ejection means and motive means. The shearing and folding assembly includes a drive roll that supplies said assembly from said side entry feed means with sheeting that has been singly folded by said feed means and which has been cut by said rotary cutting rolls. The assembly serves to shear and again fold said previously folded sheeting, thereby producing a double fold. The side entry paper sheeting feed means comprises a folding guide over which said sheeting is passed and thereafter fed through two rollers positioned substantially at right angles to said guide, thereby folding said sheeting in half. The rotary cutting rolls, paper shearing and folding assembly, product transport means and product ejection means are coordinately interconnected with, and driven by said motive means. The doubly folded product is transported to said product ejection means by said product transport means and thereupon ejected from said device.

The preceding and yet further aspects of the invention are provided by a doubly folded toilet seat cover made by the device of the preceding paragraph.

DETAILED DESCRIPTION OF THE INVENTION

Figure 1:
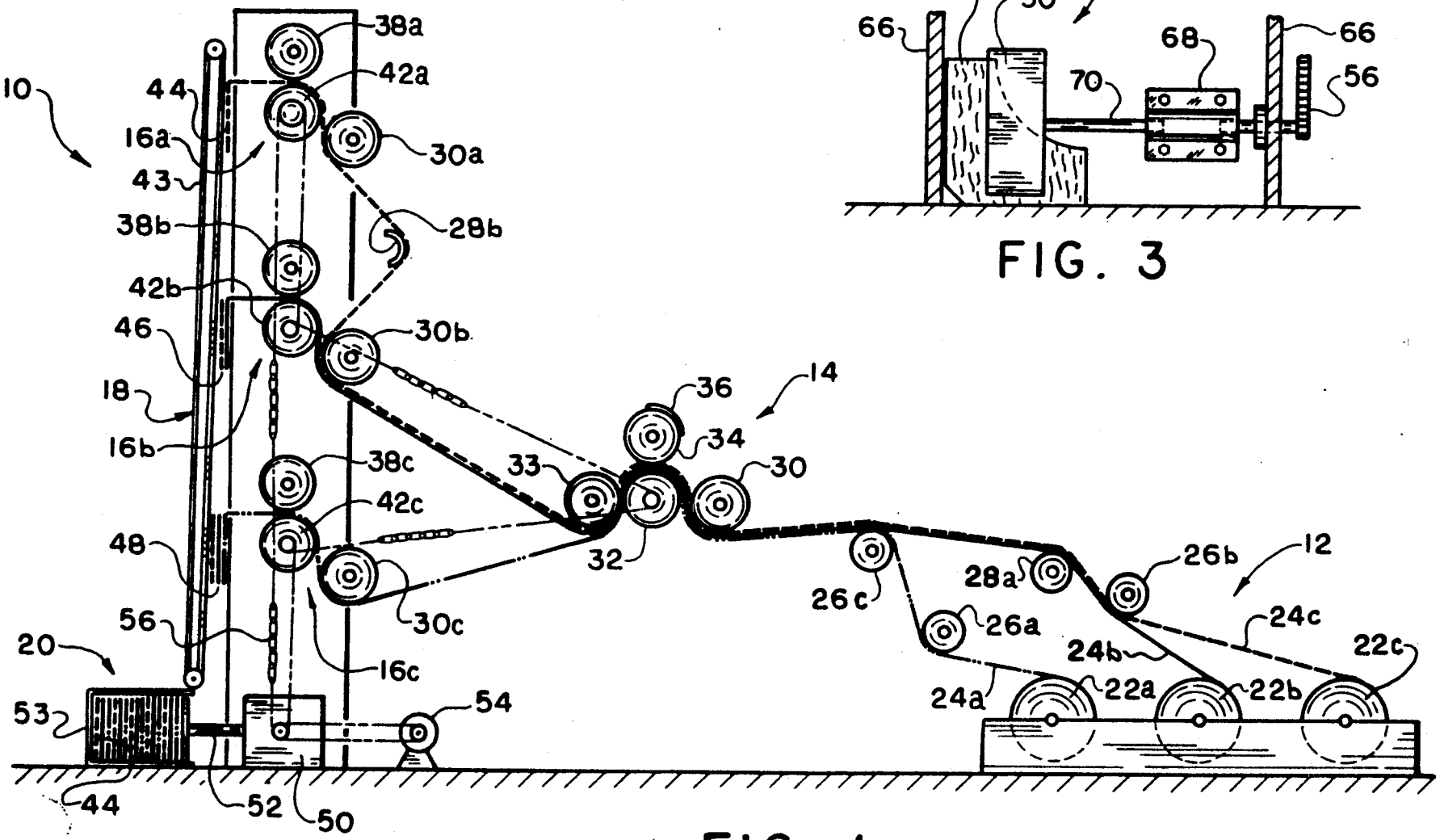
FIG. 1 is a semi-schematic, side elevational view of a three-tiered toilet seat cover processing line of the invention.

FIG. 1 is a semi-schematic, side elevational view of a three-tiered toilet seat cover processing line of the invention, generally 10. As illustrated, the line comprises a sheet feed arrangement, generally 12, which supplies paper sheeting to a paper die cutting assembly, generally 14. The latter in turn provides die cut sheeting to tiered, paper shearing and folding assemblies, generally 16*a, b,* and *c*. A product ejection assembly, generally 20, ejects the finished cut, disjoined, and folded toilet seat covers from the line.

The sheet feeding arrangement 12 includes feed rolls 22*a, b* and *c*. Roll 22*a* has its paper sheeting 24*a* directed under guide rolls 26*a* to guide roll 26*c*. The sheeting from rolls 22*b* and *c* is directed under guide roll 26*b* to a free-wheeling guide roll 28*a*, and then to a guide roll 26*c* where it joins sheeting from feed roll 22*a*. Sheets 24 are guided to a drive roll 30. From the drive roll, the now superimposed paper sheeting 24 is passed between an anvil roll 32 and a knife roll 34 having a knife 36 attached thereto and configured in the shape of the center hole and corners to be cut into the covers. From the cutting operation, two layers 24*b* and *c* of the cut paper sheeting are passed beneath the free-wheeling rubber coated roll 33 to paper shearing and folding assembly 16*b*, while one cut layer 24*a* is passed to assembly 16*c*. The double layer of sheeting arriving at assembly 16*b* is passed partially around drive roll 30*b*, one layer of sheeting continuing upwardly around guide plate 28*b* to drive roll 30*a* of assembly 16*a*. Layers 24*b* and 24*c* are fed, respectively, by drive rolls 30*a* and 30*b* to the shearing and folding assemblies 16*a* and 16*b*, respectively. At each of the assemblies 16*a, b* and *c*, a layer of the sheeting is passed between a "tucker bar roll" 38, and a "clamping roll" 42, the letters a,b, and c denoting, respectively, the rolls associated with the top, middle and bottom assemblies. As the sheeting passes between the tucker bar roll and the clamping roll, the sheeting is pushed by a bar, not shown, forming a part of the tucker bar roll into a slot, also not shown, in the clamping roll, where the sheeting is clamped in a manner causing it to receive a fold. Both the tucker bar and the clamping mechanism are operated by cam means located in bearing blocks, not shown, that hold rolls 38 and 42. The tucker bar rolls also contain a transverse knife, not shown, that shears the sheeting into disjoined toilet seat covers. The covers 44 exiting each of the assemblies 16*a, b* and *c* encounter a product transport and collating assembly, generally 18, and are transported to the product ejection assembly, generally 20. Transfer belting 43 of the transport and collating assembly, transports the covers 44 downwardly so that when the cover ejected from the top assembly 16*a* comes abreast of assembly 16*b* it meets, and is collated with the cover exiting that assembly. The two collated covers then proceed downwardly to assembly 16*c* where they meet the cover exiting therefrom, the sheave of three collated covers then continuing downwardly to the ejection assembly 20. At the ejection assembly, a product ejection mechanism 50, equipped with a synchronized product ejection ram 52, moves the collated sheaves of covers 48 into product storage chute 53, completing the manufacturing operation.

A representation drive chain 56 is shown connected to a drive motor 54, the product ejection mechanism 50, the clamping rolls 42 and the compression roll 32. The drive chain not only supplies motive power to each of the components enumerated, but assists in the synchronization of the components. If desired, multiple chains may be used to interconnect the components for drive and synchronization purposes.

As is apparent from FIG. 1, among the advantages provided by the stacked array of paper shearing and folding assemblies 16 is that it eliminates the need for individual sheet feed arrangements, as well as for multiple cutting assemblies. Furthermore, the required floor space for the multi-assembly device is no greater than that required for a single assembly machine since the supporting frame occupies no greater horizontal area than that needed for a single assembly machine. Finally, the multi-tiered machine requires only a single product ejection assembly and motor drive, further enhancing its cost effectiveness.

Inasmuch as three tiers of assemblies are superimposed in the machine as described, production rates triple those from a single machine are possible. In this connection, machines of the type described incorporating only one assembly, are capable of production rates of up to 300 covers per minute, whereas the machine of the invention allows production rates of up to 900 covers per minute to be achieved.

In addition to the increased production rates achieved by the novel tiering arrangement described, the use of the middle drive roll 30*b* to supply both the top and middle paper shearing and folding assemblies provides the notable advantage of avoiding any need to provide supplemental sheeting timing roller trains to synchronize the supply of sheeting to the top assembly. Thus synchronization problems commonly experienced when timing rollers are provided are eliminated. In other words, the machine of the invention described assures that the cover exiting the top assembly will meet that exiting from the middle assembly, and that the two covers thus collated will arrive at the bottom assembly at the proper time to be collated with the cover emerging from that assembly. Synchronization is inherently provided by the relative positions and speeds of the various rollers and guide plates in contact with the sheeting when the middle drive roll 30*b* is used to supply both the top and middle assemblies. Such synchronization is achieved by modification of machines of the Kerr type, triply tiered in accordance with the method of the invention.

As previously described, the paper die cutting assembly includes a cutting knife 36 configured to cut the center hole in the toilet seat cover, and to trim the edges thereof. The knife "mates" with a counterpart knife slot of the same shape incorporated in the surface of the compression roll 32. Gearing connects all the compression rolls in the cutting assembly so that while only the compression roll 32 is driven by the drive chain 56, the other compression rolls, i.e., 30 and 34 revolve synchronously with the driven roller. The assembly shown cuts three layers of sheeting at once, thereby taking the place of three separate cutting assemblies which are required when separate machines are utilized.

As stated, a unique feature of the machine of the invention is that two sheeting layers are fed from the middle drive roller 30*b*. The drive rollers 30*a*, 30*b* and 30*c*; however, whereas the other drive rollers 30*a* and 30*c* are covered with relatively soft rubber, e.g., that having a durometer hardness of about 70, the middle assembly drive roller 30*b* typically is somewhat higher, having a durometer hardness of around 60. As previously indicated, while the double-feed drive roller discovered facilitates the synchronous feed of the paper sheeting to the shearing and folding assemblies 16, the alternative of furnishing separate feeds to each of the top and middle stations, 16*a* and 16*b*, respectively, not only entails additional, complicated timing trains, but accurate feeding synchronization becomes difficult to achieve.

After the sheeting has been corner trimmed and its center cut as described, it is disjoined into separate toilet seat covers, and the covers are folded by means of the assemblies 16*a*, *b*, and *c*. The assemblies include the tucker bar 38 and the clamping rolls 42. Again, as the name implies, the tucker bar roll includes a bar that forces the sheeting into a corresponding slot in the clamping roll where the paper is clamped to provide the required fold, and substantially simultaneously therewith, the sheeting is sheared by a transverse knife extending across the tucker bar roll which disjoins the sheeting to form individual toilet seat covers.

The drive chain 56 engages sprockets on the clamping rolls 42, on the anvil roll 32, and on the product ejection mechanism 50, synchronizing them with each other and with the drive motor 54, which is also connected to the drive chain. In turn, gearing connects the clamping rolls 42 with the tucker bar rolls 38 and the drive rolls 30*a*, *b*, and *c*. As previously stated, gearing also connects the knife roll 34 and drive roll 30 with the chain driven anvil roll 32.

The product transport and collating assembly 18 comprises transfer belting 43 which is driven by clamping roll 42*b* in a manner not shown by FIG. 1, but which may be through contact, or other drive means of the types well known in the art. The toilet seat cover product is carried sandwiched between the moving transfer belting and stationary transfer plates, not shown, downwardly by the transfer belting to the point at which the collated sheaves 48 enter the product ejection mechanism 50 and are thereupon forced from the machine.

Figure 2A:
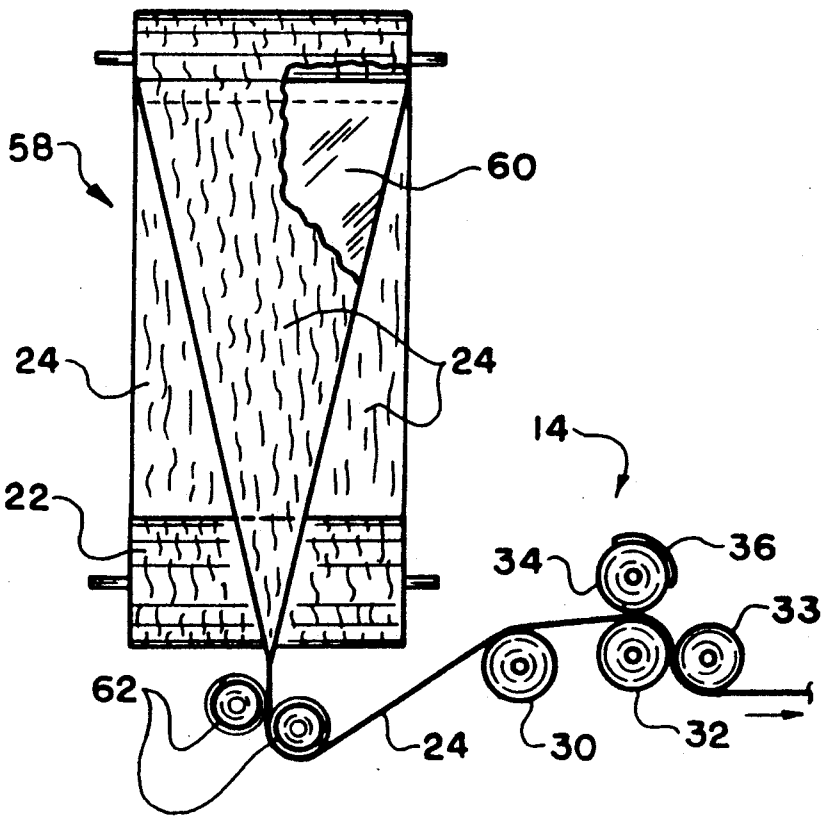
FIG. 2A is a semi-schematic, partial front elevational view of a toilet seat processing line employing a side entry paper sheeting feed system.
Figure 2:
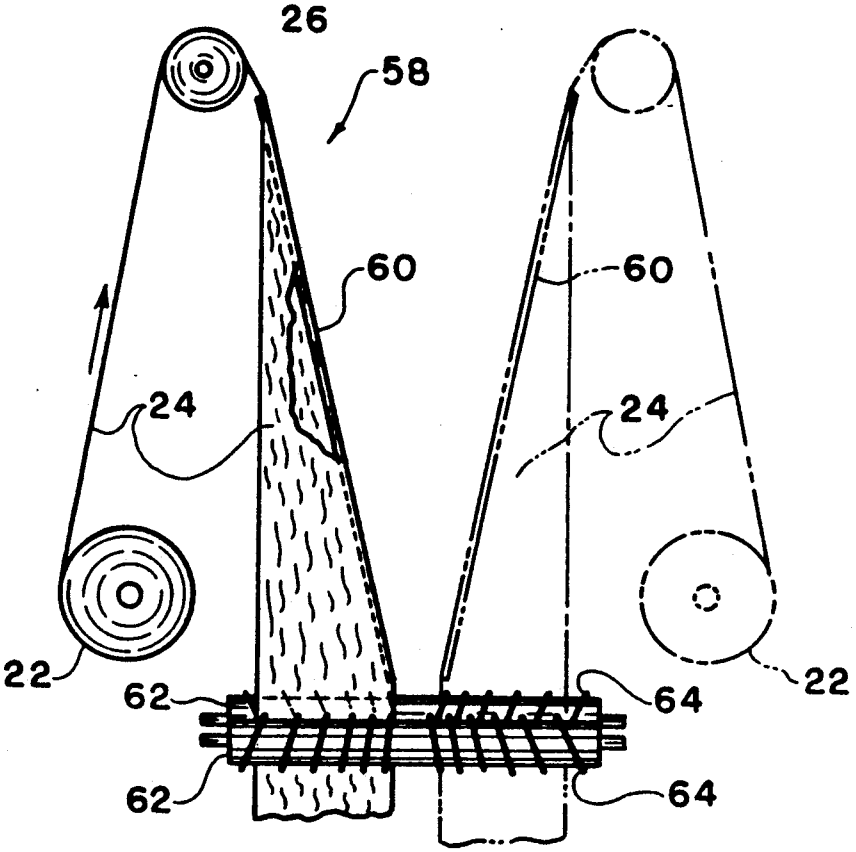
FIG. 2 is a semi-schematic, side elevational view of a side entry paper sheeting feed system of the invention of the type used to produce doubly folded toilet seat covers.

FIG. 2 is a semi-schematic, side elevational view of a side entry paper sheeting feed system of the invention of the type used to produce doubly folded toilet seat covers. As shown, paper sheeting 24 is fed from a roll 22, partially around a guide roll 26, over a substantially flat folding guide 60 and passed between smoothing rolls 62 that are provided with smoothing threads 64. In instances where two side entry feeding stations 58 are located side-by-side across from each other, two paper sheets 24 are employed, as shown in phantom.

The threads 64 comprise inscribed helical grooves having a pitch that widens as the threads proceed outwardly from the center of the rollers. The purpose of the threads is to exert an outward force on the paper sheeting passing in contact therewith, tending to force the sheeting outwardly, smoothing it in the process. As may be seen in the figure, this requires a counterclockwise thread on one of the rollers and a clockwise thread on the corresponding half of the adjacent roller. Where a pair of such rollers serves two sheeting feeds, similar threads extend outwardly from the center to the other end of each of the rollers to smooth the other sheet. Threads are required on each of the rollers to assure that each surface, i.e., the upper and lower surface of the sheeting, which is folded in half when it passes between the rollers, makes contact with smoothing threads of a roller.

A thread pitch that increases as it moves outwardly toward the end of the rollers is preferred, since it has been found that when the pitch remains constant, there is a tendency for the rollers to form ridges in the sheeting, rather than to smooth it.

The depth of the thread groove is not particularly important so long as it is at least deep enough to exert a lateral force on sheeting that comes in contact with it; however, it has been found that a thread depth of at least about 1/16 of an inch is desirable to achieve the smoothing effect described.

As previously indicated, side entry feed systems can be located opposite each other, and it has been found that by superimposing two paper shearing and folding assemblies 16 in a multi-station machine, four such side entry feed systems can be used to feed the machines. In such cases, the superimposed, folded paper sheeting emerging from between each side of rollers 62 of each of the systems proceeds side-by-side into the machine and is processed in a manner similar to that described in connection with FIG. 1, but in which no top machine is included in the stacked array.

FIG. 2A is a semi-schematic, partial front elevational view of a toilet seat cover processing line employing the side entry paper feed system of the invention. As shown in the Figure, paper sheeting 24 is fed from feed roll 22 over a triangularly shaped folding guide 60. Paper thus folded is fed between smoothing rolls 62 positioned at substantially right angles to the folding guide, thereafter proceeding over drive roll 30 and between anvil roll 32 and knife roll 34. While not shown in the Figure, after being cut in the paper die cutting assembly 14, the paper is fed through a paper shearing and folding assembly similar to the assemblies 16 of FIG. 1. In instances where two machines are superimposed on each other in a stacked array, and feeding stations 58 are located opposite each other with two such oppositely positioned feed system being provided, two layers of adjacent folded sheeting proceed side-by-side through the paper die cutting assembly 14. The cut layers are thereafter separated and fed side-by-side to different superimposed paper shearing and folding assemblies, for example, similar to those illustrated by **16*b* and 16*c* of FIG. 1**.

Figure 3:
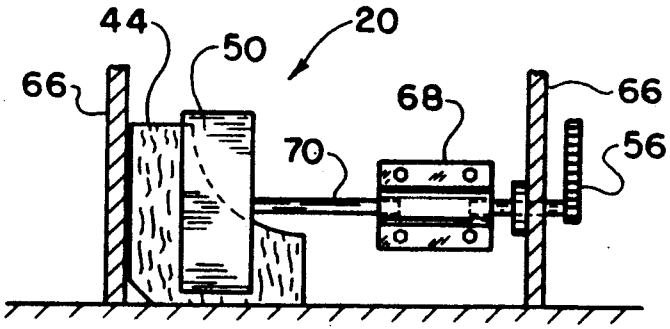
FIG. 3 is a semi-schematic, rear elevational view of a transversely adjustable product ejection device of the invention, used to eject product seat covers from a toilet seat cover processing line.

FIG. 3 is a semi-schematic, rear elevational view of a transversely adjustable product ejection device used to eject product seat covers from a toilet seat cover processing line. In the Figure, the product ejection assembly, generally 20, is shown comprising a product ejection mechanism 50 transversely positioned by a transverse adjustment coupling 68 to one of the machine's side supports 66. The ejection mechanism is operated by driven chain 56 to eject toilet seat covers 44 from the machine.

Operation of the product ejection mechanism is synchronized by drive chain 56 that operates a cam mechanism, not shown, which activates the product ejection ram 52, better seen in FIG. 1, to push sheaves of the collated product 44 from the machine.

The use of the adjustment means, illustrated in the example by an adjustment coupling 68, permits lateral adjustment of the ejection mechanism to accommodate changes in the product for which the machine is currently being used. For example, when the machine is switched from the doubly-folded, one-quarter toilet seat covers, illustrated in FIG. 3, to singly folded one-half covers, an adjustment of the ejection mechanism 50, entailing its movement to the center in the exemplification of FIG. 3, is required. In the case of the Figure, the adjustment is made by a split coupling, and in the course of adjustment, bolts holding the two sides of the split coupling together are loosened and the shaft 70 is moved further into the coupling, after which the bolts are again tightened, completing the transverse adjustment.

While the invention has been described in connection with the production of toilet seat covers, the device also lends itself to the fabrication of other cut and folded products.

While in accordance with the patent statutes, a preferred embodiment and best mode has been presented, the scope of the invention is not limited thereto but is measured by the scope of the attached claims.

What is claimed is:

1. A device for fabricating out, disjoined and singly folded paper products from rolls of paper sheeting comprising:

sheeting feet means;
rotary cutting rolls;
paper shearing and folding assemblies;
product transport and collating means;
product ejection means; and
motive means, in which each of said assemblies includes a drive roll that supplies at least one of said assemblies with sheeting from said sheeting feed means that has been cut by said rotary cutting rolls, said assemblies serving to shear and fold said sheeting, wherein three of said assemblies are mounted one over the other in a vertical array comprising top, middle, and bottom said assemblies, the drive roll of said middle assembly supplying cut sheeting to the drive roll of said top assembly, as well as to said middle assembly, and wherein said rotary cutting rolls, paper shearing and folding assemblies, transport and collating means, and product ejection means are coordinately interconnected, with and driven by said motive means, and wherein further, finished product exiting from said top assembly is transported to, and collated with said product exiting from said middle assembly, and said collated product is transported to, and collated by said product transport and collating means with such product exiting from said bottom assembly, and the product thus collated is then ejected from said device by said product ejection means.

2. A device according to claim 1 wherein said paper products are toilet seat covers, and wherein said rotary cutting rolls cut seat cover holes in said sheeting and seat cover corners in the edges thereof, and wherein further, said shearing and folding assemblies shear the sheeting into disjoined seat covers and fold said seat covers in half.

* * * * *